US011692496B2

(12) United States Patent
Xu et al.

(10) Patent No.: US 11,692,496 B2
(45) Date of Patent: Jul. 4, 2023

(54) METHOD AND DEVICE FOR CAPTURING TRIP SIGN OF TURBINE DUE TO HIGH BEARING TEMPERATURE BASED ON CORRELATION

(71) Applicant: ZHEJIANG UNIVERSITY, Hangzhou (CN)

(72) Inventors: Zhengguo Xu, Hangzhou (CN); Yong Xiong, Hangzhou (CN); Zijun Que, Hangzhou (CN); Peng Cheng, Hangzhou (CN); Jiming Chen, Hangzhou (CN)

(73) Assignee: ZHEJIANG UNIVERSITY, Hangzhou (CN)

( * ) Notice: Subject to any disclaimer, the term of this patent is extended or adjusted under 35 U.S.C. 154(b) by 18 days.

(21) Appl. No.: 17/367,413

(22) Filed: Jul. 4, 2021

(65) Prior Publication Data

US 2022/0298982 A1 Sep. 22, 2022

(30) Foreign Application Priority Data

Mar. 22, 2021 (CN) ..... 202110301867.0

(51) Int. Cl.

| | |
|---|---|
| ***F01D 21/12*** | (2006.01) |
| ***F01D 21/14*** | (2006.01) |
| ***F02D 35/02*** | (2006.01) |
| *F01D 25/16* | (2006.01) |

(52) U.S. Cl.

CPC ..... *F02D 35/02* (2013.01); *F01D 21/12* (2013.01); *F01D 21/14* (2013.01); *F01D 25/16* (2013.01); *F05D 2260/80* (2013.01); *F05D 2260/81* (2013.01); *F05D 2270/3032* (2013.01); *F05D 2270/334* (2013.01)

(58) Field of Classification Search

CPC ..... F01D 21/12; F01D 21/14; F01D 21/16; F05D 2260/80; F05D 2260/81; F05D 2260/821; F05D 2270/3032; F05D 2270/334

See application file for complete search history.

(56) References Cited

U.S. PATENT DOCUMENTS

2015/0322924 A1* 11/2015 Menasanch De Tobaruela ..... F03D 1/06 73/660
2019/0049339 A1* 2/2019 Fishkin ..... G01M 13/04
2019/0360357 A1* 11/2019 Aguilar ..... F16C 25/06

* cited by examiner

*Primary Examiner* — Courtney D Heinle
*Assistant Examiner* — Andrew J Marien
(74) *Attorney, Agent, or Firm* — W&G Law Group

(57) ABSTRACT

The present disclosure discloses a method for capturing a trip sign of a turbine due to a high bearing temperature based on correlation and a device therefor. By combining a temperature of a target bearing and related operating parameters thereof, this method can capture possible abnormal trip online. According to the present disclosure, it is not necessary to add additional detection equipment, and it does not need to establish a complex physical model for turbine bearings, and only the historical data of the operating parameters of the temperature of the target bearing and generator set operating parameters related to the temperature of the target bearing are required to complete the establishment of the model for capturing abnormal sign before the trip, which is convenient for popularization and application.

10 Claims, 4 Drawing Sheets

METHOD AND DEVICE FOR CAPTURING TRIP SIGN OF TURBINE DUE TO HIGH BEARING TEMPERATURE BASED ON CORRELATION

TECHNICAL FIELD

The present disclosure relates to the field of abnormality detection of a generator set, in particular to a method for detecting abnormal signs before a trip of a large thermal generator set due to a high bearing temperature.

BACKGROUND

As an important part of the thermal power generator set, the turbine bearing plays the role of supporting the rotor. Once its abnormal trip occurs, it will not only cause safety accidents, but also cause huge economic losses to the power plant. However, due to its special working conditions, the frequency of bearing faults is much higher than that of other components. Therefore, if possible trip faults can be detected in advance, we can make preparations and even prevent the occurrence of faults. At present, more and more researches focus on abnormality detection of the thermal generator sets, and the methods are mainly divided into model-based and data-driven categories. The model-based methods need to fully understand the mechanism of the thermal generator sets and establish an accurate model, which is very difficult under complex working conditions. Data-driven methods are like machine learning methods, which train a suitable model for abnormality detection through a large number of case data. However, a large number of abnormal case data for training models are generally difficult to obtain. Therefore, it is difficult to detect the abnormal sign before a trip of a turbine due to a high bearing temperature in a thermal generator set.

SUMMARY

The purpose of the present disclosure is to solve the technical problem that the trip sign of a turbine due to a high bearing temperature cannot be captured in advance, and to provide a method for capturing a trip sign of a turbine due to a high bearing temperature based on correlation. This method can capture the possible abnormal trip online by combining the temperature of a target bearing and related operating parameters thereof. In the present disclosure, the so-called "trip of a turbine due to a high bearing temperature" means that the turbine bearing has a trip fault due to a high temperature.

In order to achieve the purpose of the present disclosure, the specific technical solution adopted by the present disclosure is as follows:

A method for capturing a trip sign of a turbine due to a high bearing temperature based on correlation, including the following steps:

S1, monitoring in real time a temperature of a target bearing in a turbine and generator set operating parameters correlated to the temperature of the target bearing, and obtaining time-series change data of each monitoring index. The generator set operating parameters include a temperature of a paired bearing, X-direction vibration of the target bearing and Y-direction vibration of the paired bearing, and the paired bearing is a bearing which is matched with the target bearing to support a same turbine cylinder;

S2, calculating a first correlation coefficient between the temperature of the target bearing and the temperature of the paired bearing in a current time window according to the time-series change data obtained in S1, and judging whether the first correlation coefficient exceeds a first threshold range. The first threshold range is a variation range of a correlation coefficient between the temperature of the target bearing and the temperature of the paired bearing in a normal operation state of the turbine without trip faults;

S3, performing a Box-Cox transformation for a X-direction vibration signal of the target bearing and a Y-direction vibration signal of the paired bearing in the current time window according to the time-series change data obtained in S1, then calculating a second correlation coefficient between the two vibration signals after the transformation, and judging whether the second correlation coefficient exceeds a second threshold range. The second threshold range is a variation range of the correlation coefficient between the X-direction vibration signal of the target bearing after the Box-Cox transformation and the Y-direction vibration signal of the paired bearing after the Box-Cox transformation under the normal operation state without trip faults;

S4, determining that the turbine has a trip sign due to a high bearing temperature if it is monitored that the first correlation coefficient exceeds the first threshold range and the second correlation coefficient exceeds the second threshold range in the current time window.

Compared with the prior art, the method and the device of the present disclosure have the following beneficial effects:

1. The method for capturing a trip sign of a turbine of the present disclosure captures the abnormal sign before the trip according to whether the correlation of the operating parameters changes abnormally, and has simple calculation, easy to implement and has strong generalization ability.

2. The method for capturing a trip sign of a turbine of the present disclosure does not need to add additional detection equipment, and does not need to establish a complex physical model for turbine bearings, but only needs the historical data of operating parameters of a temperature of the target bearing and generator set operating parameters related to the temperature of the target bearing to complete the establishment of the abnormal sign capturing model before a trip, which is convenient for popularization.

3. The method for capturing a trip sign of a turbine of the present disclosure can detect the possible trip abnormality earlier, which is beneficial to prepare for the abnormality handling of the generator set in advance.

DESCRIPTION OF EMBODIMENTS

Figure 1:
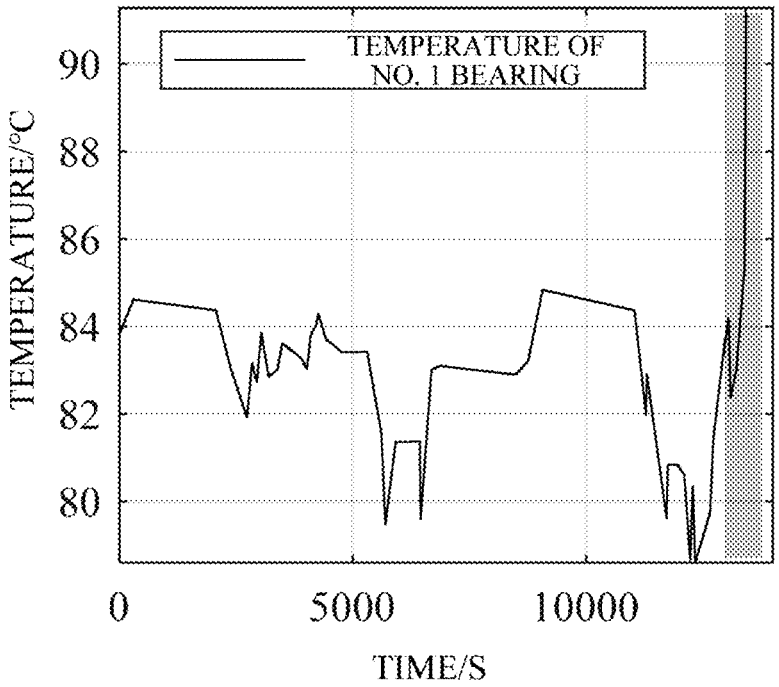
FIG. 1 is an original temperature graph of the No. 1 bearing in an embodiment of the present disclosure.

In order to better understand the present disclosure, various aspects of the present disclosure will be described in more detail with reference to the drawings. It should be understood that these detailed descriptions are only descriptions of exemplary embodiments of this application, and do not limit the scope of this application in any way.

In an embodiment of the present disclosure, a method for capturing a trip sign of a turbine due to a high bearing temperature based on correlation analysis of bearing operating parameters is provided, which includes the following steps.

S1, a temperature of a target bearing in a turbine and generator set operating parameters related to the temperature of the target bearing in real time are monitored in real time, and time-series change data of each monitoring index is obtained; wherein the generator set operating parameters include a temperature of a paired bearing, X-direction vibration of the target bearing and Y-direction vibration of the paired bearing. Therefore, there are four monitoring indexes in the present disclosure, and the data obtained by sampling each monitoring index at different times constitute its time-series change data, that is, time-series data that changes in real time, and each monitoring index has one data point at each time.

Generally speaking, there are many cylinders in a turbine, and the rotating shaft of each cylinder is supported by a pair of bearings. In the present disclosure, the target bearing refers to the bearing in the turbine that needs to be monitored whether there is a trip sign due to a high temperature, while the paired bearing refers to the bearing that supports the same turbine cylinder in cooperation with the target bearing. For example, the No. 1 bearing and the No. 2 bearing support a turbine cylinder together. If the No. 1 bearing is the target bearing to be monitored for temperature, then the No. 2 bearing is the paired bearing of target bearing. Similarly, if the No. 2 bearing is the target bearing to be monitored for temperature, then the No. 1 bearing is the paired bearing of the target bearing.

It should be noted that, among the above four monitoring indexes, the correlation can be divided into two categories through the analysis of the change law of the data of each index. There is a linear correlation between the temperature of the target bearing and the temperature of the paired bearing, while there is a nonlinear correlation between the X-direction vibration of the target bearing and the Y-direction vibration of the paired bearing. For the linear correlation, a correlation coefficient be can directly calculated, and then whether the temperature of the target bearing may be abnormal is reflected by the correlation coefficient. However, the data of the nonlinear correlation is non-normal, so the correlation coefficient cannot be directly calculated, so it needs to be preprocessed by a nonlinear transformation.

In addition, in the present disclosure, the X-direction vibration of the target bearing refers to the vibration of the target bearing along the X-axis, and the Y-direction vibration of the paired bearing refers to the vibration of the paired bearing along the Y-axis. For convenience of description, the X-axis direction of the target bearing is defined as the horizontal radial direction in the plane where the bearing is located, the Y-direction of the paired bearing is the vertical radial direction in the plane in which the bearing is located, and the plane in which one bearing is located refers to a bearing cross section axially perpendicular to the bearing.

S2, the temperature data of the target bearing and the temperature data of the paired bearing in the current time window are extracted according to the time-series change data of the four monitoring indexes obtained in S1, then the correlation coefficient (denoted as the first correlation coefficient) between the two groups of data is calculated, and whether the first correlation coefficient exceeds a first threshold range is judged. It should be noted that the first threshold range is the variation range of the correlation coefficient between the temperature of the target bearing and the temperature of the paired bearing in the normal operation state of the turbine without trip faults.

S3, according to the time-series change data of the four monitoring indexes obtained in S1, the X-direction vibration signal data of the target bearing and the Y-direction vibration signal data of the paired bearing in the current time window are extracted. Since the vibration signal data of bearings belong to nonlinear data, Box-Cox transformation is performed on the X-direction vibration signal data of the target bearing and the Y-direction vibration signal data of the paired bearing respectively to improve the normality, symmetry and variance equality of the data, then the correlation coefficient (referred to as the second correlation coefficient) between the two vibration signals after transformation is calculated, and whether the second correlation coefficient exceeds a second threshold range is judged. It should be noted that the second threshold range is the variation range of the correlation coefficient between the X-direction vibration signal of the target bearing after the Box-Cox transformation and the Y-direction vibration signal of the paired bearing after the Box-Cox transformation in the normal operation state without trip faults.

S4, after the judgment results are obtained respectively in S2 and S3, the judgment results in S2 and S3 need to be output in AND mode to finally determine whether the turbine has a trip sign due to a high bearing temperature or not, that is, only when the first correlation coefficient exceeds the first threshold range and the second correlation coefficient exceeds the second threshold range in the current time window, can the turbine be judged to have the trip sign due to a high bearing temperature; if at most one judgment result exceeds the threshold value, it will not be judged that the turbine will show a trip sign due to a high bearing temperature. In this way, the occurrence of false positives can be effectively reduced.

It should be noted that the correlation coefficient in the present disclosure can take various forms. Preferably, a Pearson correlation coefficient is recommended for both the first correlation coefficient and the second correlation coefficient, and their calculation formula is $$\rho_{X,Y} = \frac{E(XY) - E(X)E(Y)}{\sqrt{E(X^2) - [E(X)]^2}\sqrt{E(Y^2) - [E(Y)]^2}},$$

where X,Y are two index data sequences for calculating the correlation; $\rho_{X,Y}$ is the correlation coefficient between X,Y, ranging from −1 to 1, with negative number indicating negative correlation and 0 indicating no correlation. The greater the absolute value of the correlation coefficient, the stronger the correlation; E indicates expectation.

Similarly, a normal range of the Pearson correlation coefficient is also recommended correspondingly for the first threshold range and the second threshold range. The first threshold range and the second threshold range can be calculated from a large number of historical monitoring data of the same turbine in a normal operation without trip faults.

A specific method for determining the first threshold range and the second threshold range is provided as below:

1. In the normal operation state of a turbine without trip faults, the temperature of the target bearing, the temperature of the paired bearing, X-direction vibration of the target bearing and Y-direction vibration of the paired bearing are continuously monitored, so as to accumulate historical data sets of four monitoring indexes, and establish a training data set after eliminating abnormal value data of various operating parameters. The training set can be expressed as $\{x_i^1, x_i^2, \ldots, x_i^L\}$, i=1, 2, . . . , N, N is the length of a time sequence of the operating parameters collected from the training set, and L is the total number of the operating parameters.

2. For linearly related parameters, i.e., the temperature of the target bearing and the temperature of the paired bearing, a Pearson correlation coefficient calculation formula is directly used to obtain the linear correlation coefficient between operating parameters, and a value range of the linear correlation coefficient, i.e., the first threshold range, is obtained according to a large number of historical data at a normal time in the operating state without abnormal trips.

3. For nonlinear related parameters, i.e., X-direction vibration of the target bearing and Y-direction vibration of the paired bearing, firstly, Box-Cox transformation is carried out on the two vibration parameter data, and then Pearson formula is used to obtain the correlation coefficient between the transformed parameters to obtain the nonlinear correlation coefficient; the value range of the nonlinear correlation coefficient, i.e., the second threshold range, is obtained according to a large number of historical data at normal time without abnormal trips.

Because the historical data set in normal operation state is a group of time series data, the calculation of the correlation coefficient needs to take the data in a period of time as samples. Therefore, in the calculation process of the first threshold range and the second threshold range, the whole historical data set can be slid by time window, and each time window is regarded as a group of data samples for calculating correlation coefficients (including linear correlation coefficients and nonlinear correlation coefficients). Therefore, an appropriate step length can be selected to move the sliding window, and the data in each step length is used to calculate a linear correlation coefficient and a nonlinear correlation coefficient. The last time of each sliding window can be used as the time to calculate the correlation coefficient in the current window. Therefore, the two types of correlation coefficients obtained correspondingly through calculation for each sliding window can be combined into two time-series curves of correlation coefficients, which can be used to determine their respective threshold ranges.

In addition, it should be noted that the finally determined value ranges (the first threshold range and the second threshold range) of the correlation coefficient in a normal operation state should meet the following requirements: the correlation coefficient values at all normal times can be included, and the normal time can be distinguished from the abnormal time of trip, and the more obvious the difference, the better. In the present disclosure, the first threshold range is recommended to be [−1, −0.7] and the second threshold range is recommended to be [−0.1, 0.2] after a large number of parameters are optimized.

The Box-Cox transformation adopted in this invention belongs to the prior art, and the formula of the Box-Cox transformation is $$y(\lambda) = \frac{y^{\lambda} - 1}{\lambda},$$

where y is a parameter value before transformation, and λ is a transformation parameter, which is a hyperparameter. The concrete value of the transformation parameter λ can be determined by the maximum likelihood method, and the steps for defining the transformation parameter are as follows:

1) The transformation parameter λ satisfies the formula $Y^{\lambda}=\beta X+e$, $e\sim N(0,\delta^2 I)$, which means that after Box-Cox transformation, the vectors X and Y have a linear relationship, and the error obeys a normal distribution;

2) λ is determined by the maximum likelihood method, and the likelihood function of β and $\delta^2$ is $$L(\beta, \delta^2) = \frac{\exp\left(-\frac{1}{2\delta^2}(Y^{(\lambda)} - \beta X)^T (Y^{(\lambda)} - \beta X)\right)}{(2\pi\delta^2)^{n/2}} J(\lambda, y),$$

where J(λ, y) indicates a transformation from y to y(λ), and has the following specific form:

$$J(\lambda, y) = \prod_{i=1}^{n} \left| \frac{dy_1^{(\lambda)}}{dy} \right| = \prod_{i=1}^{n} y_i^{\lambda-1};$$

3) By differentiating the likelihood function, and using the derivative as 0, β and $\delta^2$ are obtained, the maximum likelihood equation is obtained through $\beta(\lambda)=(X^TX)^{-1}X^TY^{(\lambda)}$ and $$\delta^2(\lambda) = \frac{Y^{(\lambda)^T}(I - X(X^TX)^{-1}X^T Y^{(\lambda)}}{n},$$

and then the value of λ is obtained through $L_{max}(\lambda)=(2\pi)^{-2/n}[\delta^2(\lambda)]^{-n/2}J(\lambda,y)$.

On the other hand, based on the above-mentioned method for capturing a trip sign due to a high turbine bearing temperature based on bearing operating parameter correlation analysis, the present disclosure can also provide a capturing a trip sign due to a high turbine bearing temperature based on bearing operating parameter correlation analysis, which is used to realize the functions of the above-mentioned method. The device includes a parameter monitoring module, a first judging module. a second judging module and a sign identification module. The functions of various functions are as below:

The parameter monitoring module is configured for monitoring a temperature of a target bearing in a turbine and generator set operating parameters related to the temperature of the target bearing in real time, and obtaining time-series change data of each monitoring index; wherein the generator set operating parameters include a temperature of a paired bearing, X-direction vibration of the target bearing and Y-direction vibration of the paired bearing, and the paired bearing is a bearing which is matched with the target bearing to support a same turbine cylinder;

the first judging module is configured for calculating a first correlation coefficient between the temperature of the target bearing and the temperature of the paired bearing in a current time window according to the time-series change data obtained in S1, and judging whether the first correlation coefficient exceeds a first threshold range; wherein the first threshold range is a variation range of a correlation coefficient between the temperature of the target bearing and the temperature of the paired bearing in a normal operation state of the turbine without trip faults;

the second judging module is configured for performing a Box-Cox transformation for a X-direction vibration signal of the target bearing and a Y-direction vibration signal of the paired bearing in the current time window according to the time-series change data obtained in S1, then calculating a second correlation coefficient between the two vibration signals after the transformation, and judging whether the second correlation coefficient exceeds a second threshold range; wherein the second threshold range is a variation range of the correlation coefficient between the X-direction vibration signal of the target bearing after the Box-Cox transformation and the Y-direction vibration signal of the paired bearing after the Box-Cox transformation under the normal operation state without trip faults; and the sign identification module is configured for determining that the turbine has a trip sign due to a high bearing temperature if it is monitored that the first correlation coefficient exceeds the first threshold range and the second correlation coefficient exceeds the second threshold range in the current time window.

The above-mentioned parameter monitoring module can be realized by corresponding sensors and matched signal acquisition systems, and the sensors are installed at specific positions of turbine sets for monitoring four indexes. The data obtained by the signal acquisition system can be sent to an upper computer for storage, and the first judgment module, the second judgment module and the sign recognition module can be installed in the upper computer in the form of software, integrated circuit, etc., which are used to process the corresponding signal data and finally judge whether the turbine will have a trip sign due to a high bearing temperature. In case of a trip due to a high bearing temperature, early warning can be given by alarm equipment to inform relevant personnel to prepare for abnormality handling in advance. The software and integrated circuit for realizing the above functional modules can be designed according to the prior art, and will not be described in detail in the present disclosure.

In the following, a real case of a high temperature of a turbine bearing in a thermal power plant is used to illustrate the specific operation steps and verify the effectiveness of the proposed method.

Embodiments

In this embodiment, the temperature of the target bearing is the temperature of the No. 1 bearing, and the operating parameters related to the temperature of the target bearing include the temperature of the No. 2 bearing, X-direction vibration of the No. 1 bearing and Y-direction vibration of the No. 2 bearing, and the sampling frequency of the above parameters is 1 second.

In this embodiment, the method for capturing abnormal signs before trip based on Pearson correlation coefficients and Box-Cox transformation includes the following steps:

S1, a training data set is obtained according to the temperature of the No. 1 bearing and the historical data of its related parameters, and the correlation between the parameters is divided into linear correlation and nonlinear correlation. The method specifically includes the following steps:

S101, generator operating parameter variables related to the temperature of the No. 1 bearing are selected, including the temperature of the No. 2 bearing, X-direction vibration of the No. 1 bearing and Y-direction vibration of the No. 2 bearing.

S102, the data of the operating parameters in S101 are sampled, and the sampling frequency is 1 second.

S103, abnormal value data of the operating parameters are eliminated.

S104, the correlation between the operating parameters is divided into linear correlation and nonlinear correlation, and a training set is constructed.

The training set is expressed as $\{x_i^1, x_i^2, \ldots, x_i^L\}$, i=1, 2, . . . , N, N is the number of sample points in the training set, and L is the total number of parameters.

Figure 2:
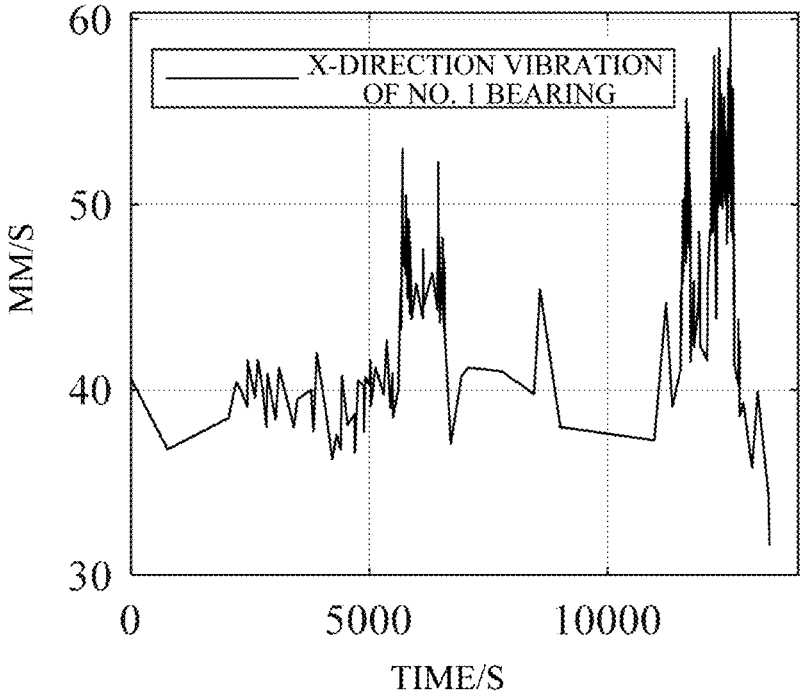
FIG. 2 is an x-direction vibration graph of the No. 1 bearing in an embodiment of the present disclosure.

According to step S1, the input of the training set is 4 operating parameters. The temperature of the No. 1 bearing is shown in FIG. 1, in which the pink shaded part indicates the abnormal period. It can be seen from FIG. 1 that the possible abnormality cannot be found in time and effectively only through the temperature curve of THE No. 1 bearing. Even if the bearing temperature is too high later, it is too late. Among the selected parameters related to the temperature of THE No. 1 bearing, the X-direction vibration curve of THE No. 1 bearing is shown in FIG. 2, and the information related to an abnormal trip cannot be obtained from the X-direction vibration curve of the No. 1 bearing.

S2, the correlation coefficients are directly calculated for the temperatures of the No. 1 and No. 2 bearings, and the value range of the linear correlation coefficient under normal conditions is obtained according to a large number of historical data at normal times, and a range finally determined is from −1 to −0.7, that is, when the correlation coefficient is greater than −0.7, it is judged that the temperature correlation relationship of the No. 1 and No. 2 bearings is abnormal. The method specifically includes the following steps:

S201, based on the previous training set, by way of a sliding window (the size of the sliding window is set to 3000), an appropriate step length (the step length here is set to 1) is selected to gradually move the sliding window, and the data in each sliding window is used to calculate the correlation coefficient between temperatures of the No. 1 and No. 2 bearings; the formula for calculating the correlation coefficient is $$\rho_{X,Y} = \frac{E(XY) - E(X)E(Y)}{\sqrt{E(X^2) - [E(X)]^2}\sqrt{E(Y^2) - [E(Y)]^2}},$$

where X,Y are time series of the operating parameters of the temperatures of the No. 1 and No. 2 bearings, E indicates expectation, and $\rho_{X,Y}$ is the correlation coefficient between X,Y, ranging from −1 to 1, with negative numbers indicating negative correlation, and 0 indicating no correlation. The larger the absolute value of the correlation coefficient, the stronger the correlation.

Figure 3:
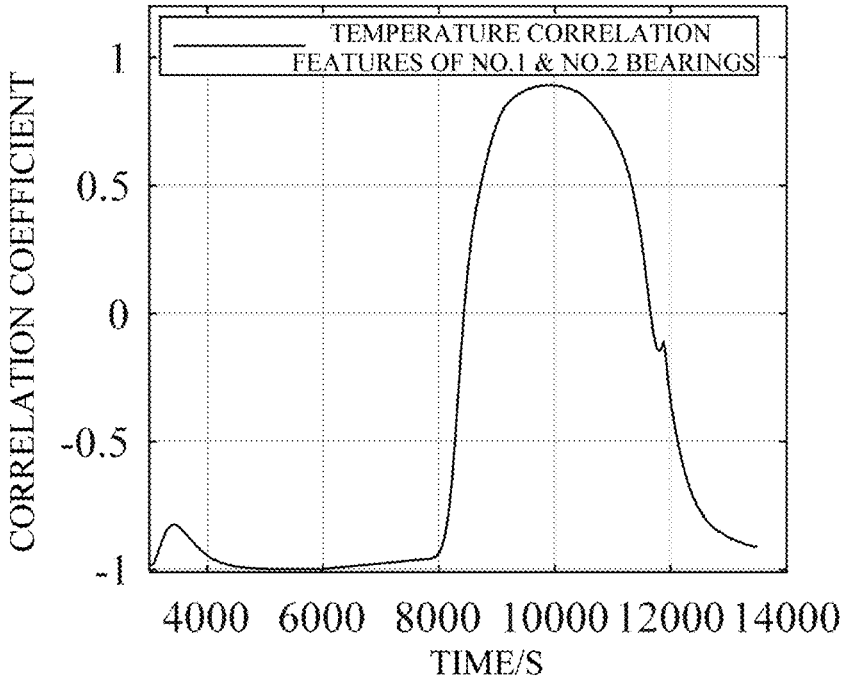
FIG. 3 is a graph showing the correlation coefficient between the temperature of the No. 1 bearing and the temperature of the No. 2 bearing in an embodiment of the present disclosure.

S202, according to the historical data at normal times, the value range of the correlation coefficient of the temperatures of the two bearings when there is no abnormal trip is determined. FIG. 3 shows the temperature correlation coefficient curves of the No. 1 and No. 2 bearings. It can be seen that the correlation coefficient between the No. 1 and No. 2 bearings is about −1 in a normal time period. Before the abnormality occurs, the correlation coefficient between them suddenly becomes 0.8 and then slowly returns to −1. During this period, the correlation coefficient changes suddenly, but in the normal time period, the correlation coefficient changes smoothly and remains in a small range, so it meets the requirement of S202 as an index variable. Then, according to a large number of historical data, the correlation coefficient of the No. 1 and No. 2 bearings in a normal time period is obtained as −1 to −0.7.

S3, for the extraction of nonlinear correlation features, firstly, the original operating parameter data is subjected to a Box-Cox transformation, then the correlation coefficient between the parameters is obtained by a Pearson calculation formula, and the value range of the linear correlation coefficient without abnormal trips is obtained according to a large number of historical data at normal times. The method specifically includes the following steps:

S301, based on the previous training set, the X-direction vibration of the No. 1 bearing and the Y-direction vibration of the No. 2 bearing are transformed by a Box-Cox transformation. The formula of the Box-Cox transformation is $$y(\lambda) = \frac{y^{\lambda} - 1}{\lambda}, 1$$

where y is the parameter value before transformation and the superparameter λ is a transformation parameter. The specific value of the transformation parameter λ is determined by the maximum likelihood method, and it is calculated as λ=8 in this embodiment.

S302, the sliding window is also adopted (the size of the sliding window is set to 3000 here), and after selecting an appropriate step length (the step length is set to 1 here), the sliding window is gradually moved on the training set after Box-Cox transformation, and the correlation coefficient between the two vibration signals after transformation is calculated by using the data in each sliding window; the calculation formula is the same as S201.

S303, the value range of the correlation coefficient when there is no abnormal trip is calculated according to the values of the correlation features of a plurality of normal time periods calculated in S302.

Figure 4:
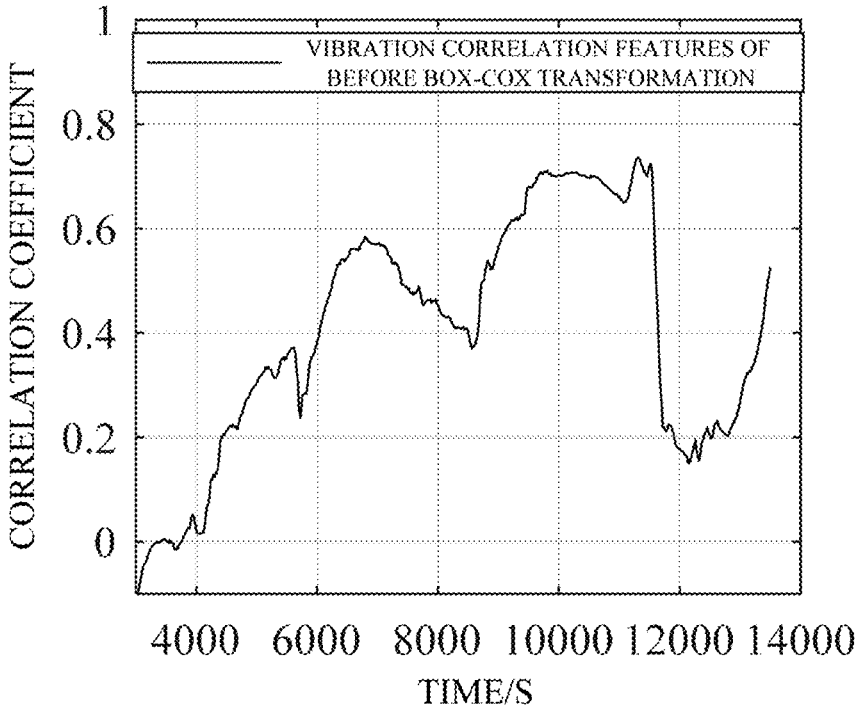
FIG. 4 is a graph of the correlation coefficient between X-direction vibration of the No. 1 bearing and Y-direction vibration of the No. 2 bearing before a Box-Cox transformation in an embodiment of the present disclosure.
Figure 5:
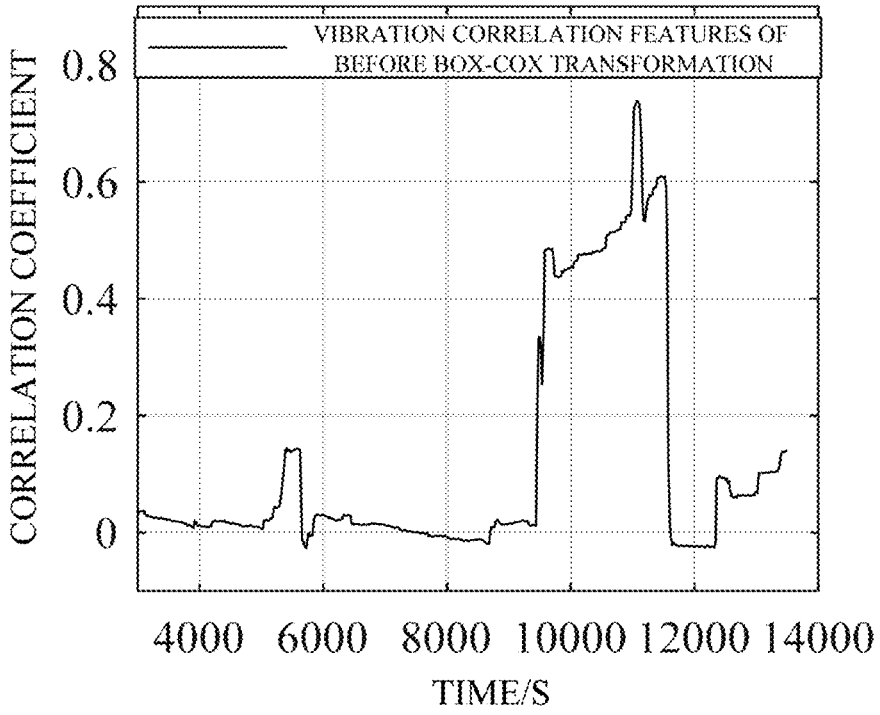
FIG. 5 is a graph of the correlation coefficient between X-direction vibration of the No. 1 bearing and Y-direction vibration of the No. 2 bearing after a Box-Cox transformation in an embodiment of the present disclosure.

According to the calculation formula for the linear correlation coefficient in S202, the correlation curve between the X-direction vibration of the No. 1 bearing and the Y-direction vibration of the No. 2 bearing before the Box-Cox transformation is calculated as shown in FIG. 4, and the information related to abnormality cannot be obtained from the correlation coefficient curve in FIG. 4. According to S303, the X-direction vibration of the No. 1 bearing and the Y-direction vibration of the No. 2 bearing are firstly subjected to Box-Cox transformation, and then the correlation coefficient curve thereof is obtained, as shown in FIG. 5. It can be seen from FIG. 5 that at normal times, the correlation between X and Y vibration of the bearings after transformation is almost zero, but before abnormality, the correlation between them suddenly increases, showing that the correlation coefficient suddenly changes from 0 to 0.5, which is kept for a period of time, and then the correlation coefficient between them suddenly decreases. Before and after the abnormality, the correlation coefficient changes obviously, which meets the requirements of the index variable in S303. Then, according to a large number of historical data, the correlation coefficient of bearing vibration in X and Y directions in normal time periods is obtained as −0.1 to 0.2.

S4, by combining the two characteristic quantities, i.e., the correlation coefficients, obtained by S2 and S3, the logical AND is used to obtain the result, which is used as the final judgment index of an abnormal trip. The method specifically includes the following steps:

S401, for a test sample, the correlation coefficient between the temperatures of the No. 1 and No. 2 bearings is calculated, and whether it exceeds the threshold value of −0.7 is calculated; if it exceeds the threshold value, 1 is recorded, otherwise, 0 is recorded.

S402, according to the superparameter λ obtained in S301, the X-direction vibration of the No. 1 bearing and the Y-direction vibration of the No. 2 bearing in the test sample are subjected to Box-Cox transformation, a correlation coefficient between the transformed vibration signals is calculated, and whether it exceeds the threshold value of the normal range is calculated; if it exceeds the threshold value, 1 is recorded, otherwise, 0 is recorded.

S403, the results of S401 and S402 are combined, and if both of the results are 1, the final result is 1, indicating that there is abnormality; otherwise, the final result is 0, indicating that there is no abnormality.

Figure 6:
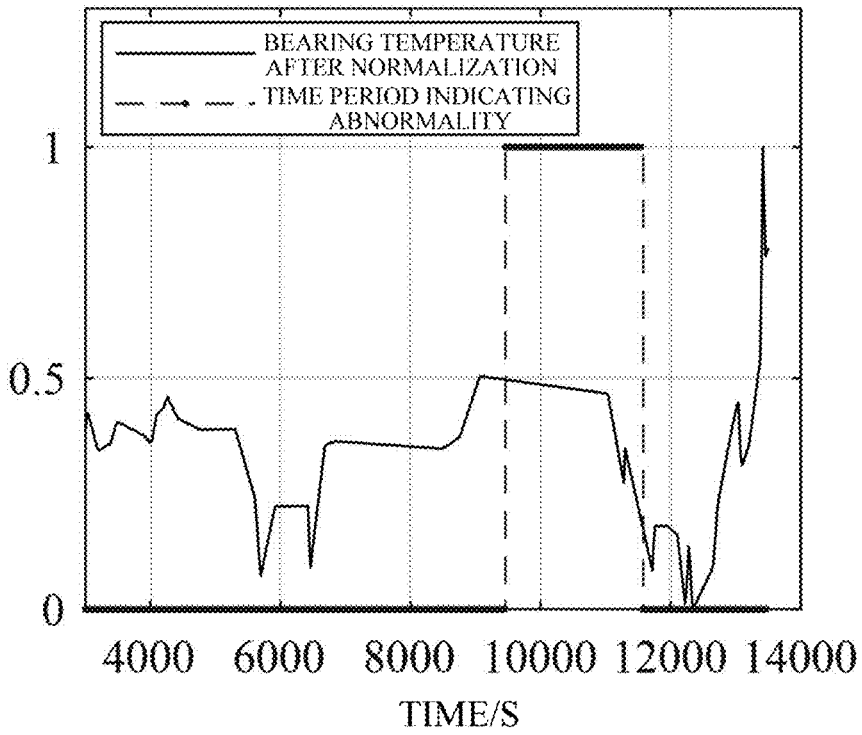
FIG. 6 is a comparison diagram of the normalized No. 1 bearing temperature and the abnormality indication time period in an embodiment of the present disclosure.

According to S403, the previous two correlation features are synthesized, that is, when both of them exceed the threshold value at the same time, it is judged that an abnormality occurs. In this embodiment, 1 indicates that this time is an abnormal state, 0 indicates a normal state, and the abnormal curve is detected as shown in FIG. 6. For the convenience of observation, the normalized temperature curve of this embodiment is also plotted in the figure, and the normalization formula is $$y_{new} = \frac{y - y_{max}}{y_{max} - y_{min}},$$

where $y_{new}$ is a normalized value, $y_{max}$ is the maximum value of the original temperature, $y_{min}$ is the minimum value of the original temperature, and y is the temperature value to be normalized. It can be read from FIG. 6 that the time when the abnormality is detected for the first time is about 8780 seconds. However, the occurrence time of the abnormality read out in FIG. 1 is about 13380 seconds, which is 4600 seconds (about 1.28 hours) ahead of time.

Since in the previous Box-Cox transformation, the concrete value of the transformation parameter λ is determined by the maximum likelihood method, the influence of the Box-Cox transformation on the detection results when the superparameter λ takes different values is calculated through a test case in order to verify whether the transformation parameters determined by this method can accurately capture the trip sign. The method specifically includes the following steps:

S501, according to the value of the superparameter λ estimated by the maximum likelihood method in s3010, several sets of values around this value are selected as the verification sets.

S502, according to S2, S3 and S4, the results of abnormality detection under different values of λ are calculated.

According to S501, several sets of values around the value of the superparameter λ obtained by estimation are selected as the verification sets, and the estimated value obtained by the maximum likelihood method is 8. Here, an integer from 2 to 14 is selected as the verification set. According to S502, the time when the abnormality is detected for the first time in the verification set is calculated, as shown in table 1.

TABLE 1

| Value of λ | The time when the abnormality is detected for the first time (s) |
|---|---|
| 2 | 8160 |
| 3 | 8160 |
| 4 | 8160 |
| 5 | 8160 |
| 6 | 8700 |
| 7 | 8820 |
| 8 | 9460 |
| 9 | 9460 |
| 10 | 9460 |
| 11 | 9460 |
| 12 | 9460 |
| 13 | 9460 |
| 14 | 9460 |

Figure 7:
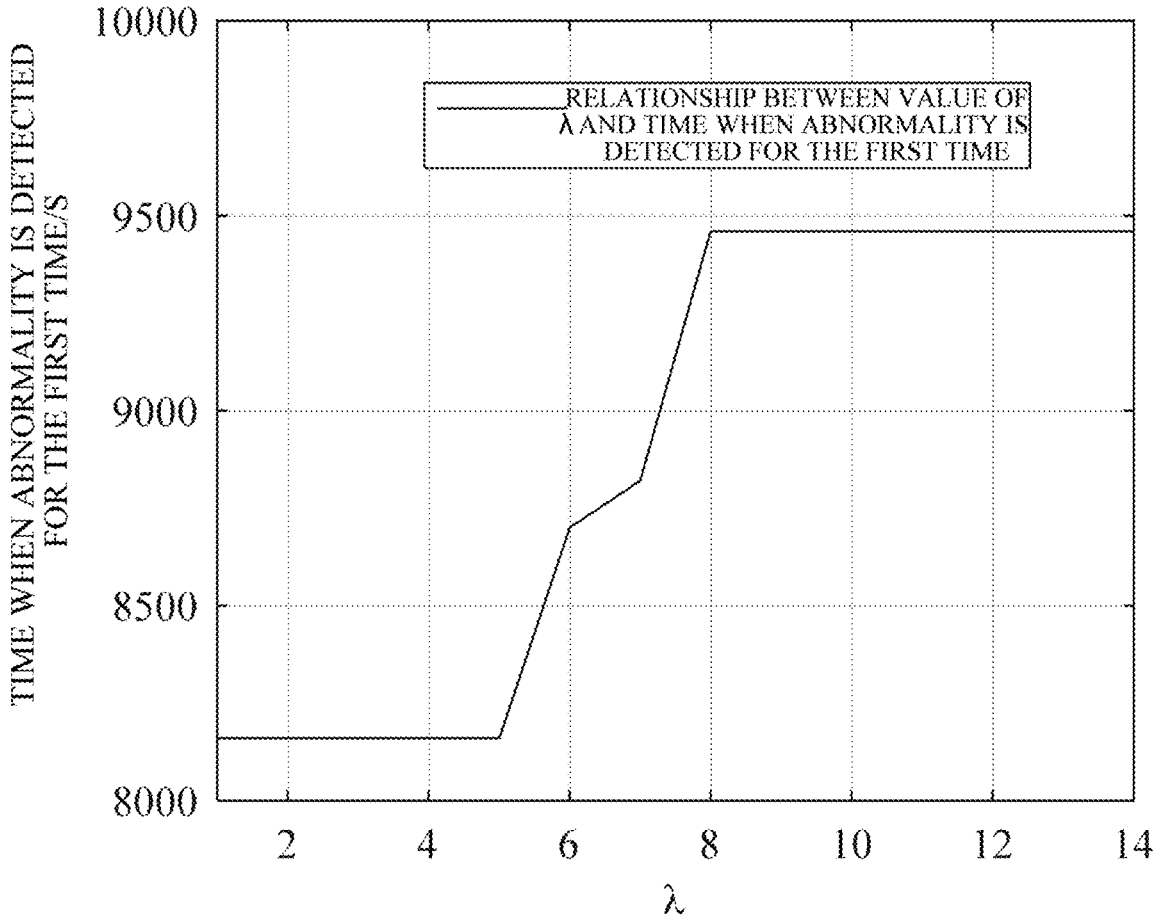
FIG. 7 is a diagram showing the relationship between the value of λ and the time at which abnormality is detected for the first time in an embodiment of the present disclosure.

The data in Table 1 is plotted as a graph as shown in FIG. 7. It can be seen from the curve diagram that the time when the abnormality is detected for the first time remains unchanged when the value of λ is from 2 to 5, gradually increases when the value of λ is 5 to 8, and remains unchanged when the value of λ is 8 to 14. Although the estimated value of λ as 8 is not the earliest alarm time, it is acceptable within the allowable range of error.

The above embodiment is only a better scheme of the present disclosure, but it is not intended to limit the present disclosure. Those of ordinary skill in the relevant technical field can make various changes and modifications without departing from the spirit and scope of the present disclosure. Therefore, all technical solutions obtained by equivalent substitution or equivalent transformation fall within the protection scope of the present disclosure.

What is claimed is:

1. A method for capturing a trip sign of a turbine due to a high bearing temperature based on correlation, comprising following steps:

S1, monitoring in real time a temperature of a target bearing in a turbine and generator set operating parameters correlated to the temperature of the target bearing, obtaining time-series change data of each of the generator set operating parameter, wherein the generator set operating parameters comprise a temperature of a paired bearing, X-direction vibration of the target bearing and Y-direction vibration of the paired bearing, capturing the temperature of the target bearing by a temperature sensor provided at the target bearing, capturing the temperature of the paired bearing by a temperature sensor provided at the paired bearing, capturing the X-direction vibration of the target bearing by a displacement sensor provided at the target bearing, and capturing the Y-direction vibration of the paired bearing by a displacement sensor provided at the paired bearing, wherein the paired bearing is configured to be matched with the target bearing and support one turbine cylinder together with the target bearing;

S2, calculating a first correlation coefficient between the temperature of the target bearing and the temperature of the paired bearing in a current time window according to the time-series change data obtained in S1, and judging whether the first correlation coefficient exceeds a first threshold range, wherein the first threshold range is a variation range of a correlation coefficient between the temperature of the target bearing and the temperature of the paired bearing in a normal operation state of the turbine without trip faults;

S3, performing a Box-Cox transformation for a X-direction vibration signal of the target bearing and a Y-direction vibration signal of the paired bearing in the current time window by a processor according to the time-series change data obtained in S1, then calculating a second correlation coefficient between the two vibration signals after the transformation, and judging whether the second correlation coefficient exceeds a second threshold range, wherein the second threshold range is a variation range of the correlation coefficient between the X-direction vibration signal of the target bearing after the Box-Cox transformation and the Y-direction vibration signal of the paired bearing after the Box-Cox transformation under the normal operation state without the trip faults; and S4, determining that the turbine has the trip sign due to a high bearing temperature if when the processor monitors that the first correlation coefficient exceeds the first threshold range and the second correlation coefficient exceeds the second threshold range in the current time window; and performing warning by a warning device when the turbine has the trip sign due to the high bearing temperature.

2. The method for capturing the trip sign of the turbine due to the high bearing temperature according to claim 1, wherein the first correlation coefficient and the second correlation coefficient are both Pearson correlation coefficients.

3. The method for capturing the trip sign of the turbine due to the high bearing temperature according to claim 1, wherein both the first threshold range and the second threshold range are calculated from historical monitoring data of a same turbine in the normal operation state without the trip faults.

4. The method for capturing the trip sign of the turbine due to the high bearing temperature according to claim 1, wherein a transformation parameter λ is determined by a maximum likelihood method during the Box-Cox transformation.

5. The method for capturing the trip sign of the turbine due to the high bearing temperature according to claim 1, wherein the first threshold range is set as [−1, −0.7], and the second threshold range is set as [−0.1, 0.2].

6. A device for capturing a trip sign of a turbine due to a high bearing temperature based on correlation, comprising:

at least one processor, and a memory coupled to the at least one processor, wherein the memory stores programmable instructions which cause the at least one processor to:

a parameter monitoring module configured to monitor in real time a temperature of a target bearing in a turbine and generator set operating parameters correlated to the temperature of the target bearing, obtain time-series change data of each of the generator set operating parameter, wherein the generator set operating parameters comprise a temperature of a paired bearing, X-direction vibration of the target bearing and Y-direction vibration of the paired bearing, capturing the temperature of the target bearing by a temperature sensor provided at the target bearing, capturing the temperature of the paired bearing by a temperature sensor provided at the paired bearing, capturing the X-direction vibration of the target bearing by a displacement sensor provided at the target bearing, and capturing the Y-direction vibration of the paired bearing by a displacement sensor provided at the paired bearing, wherein the paired bearing is configured to be matched with the target bearing and support one turbine cylinder together with the target bearing;

a first judging module configured to calculate a first correlation coefficient between the temperature of the target bearing and the temperature of the paired bearing in a current time window according to the time-series change data, and judge whether the first correlation coefficient exceeds a first threshold range, wherein the first threshold range is a variation range of a correlation coefficient between the temperature of the target bearing and the temperature of the paired bearing in a normal operation state of the turbine without trip faults;

a second judging module configured to perform a Box-Cox transformation for a X-direction vibration signal of the target bearing and a Y-direction vibration signal of the paired bearing in the current time window by the at least one processor according to the time-series change data, then calculate a second correlation coefficient between the two vibration signals after the Box-Cox transformation, and judge whether the second correlation coefficient exceeds a second threshold range, wherein the second threshold range is a variation range of the correlation coefficient between the X-direction vibration signal of the target bearing after the Box-Cox transformation and the Y-direction vibration signal of the paired bearing after the Box-Cox transformation under the normal operation state without the trip faults; and a sign identification module configured to determine that the turbine has the trip sign due to the high bearing temperature when the at least one processor monitors that the first correlation coefficient exceeds the first threshold range and the second correlation coefficient exceeds the second threshold range in the current time window, and to perform warning by a warning device when the turbine has the trip sign due to the high bearing temperature.

7. The device for capturing the trip sign of the turbine due to the high bearing temperature according to claim 6, wherein the first correlation coefficient and the second correlation coefficient are both Pearson correlation coefficients.

8. The device for capturing the trip sign of the turbine due to the high bearing temperature according to claim 6, wherein both the first threshold range and the second threshold range are calculated from historical monitoring data of a same turbine in the normal operation state without the trip faults.

9. The device for capturing the trip sign of the turbine due to the high bearing temperature according to claim 6, wherein a transformation parameter $\lambda$ is determined by a maximum likelihood method during the Box-Cox transformation.

10. The device for capturing the trip sign of the turbine due to the high bearing temperature according to claim 6, wherein the first threshold range is set as [−1, −0.7], and the second threshold range is set as [−0.1, 0.2].

* * * * *